United States Patent [19]

Bauer et al.

[11] Patent Number: 4,542,999

[45] Date of Patent: Sep. 24, 1985

[54] REMOVABLE PRINTING DISC COUPLING FOR PRINTING MACHINE

[75] Inventors: Eric Bauer, Neuchatel; Blaise Moulin, Corcelles, both of Switzerland

[73] Assignee: Caracteres S.A., Neuchatel, Switzerland

[21] Appl. No.: 481,289

[22] Filed: Apr. 1, 1983

[30] Foreign Application Priority Data

Apr. 5, 1982 [CH] Switzerland ..... 2070/82

[51] Int. Cl.[4] ..... B41J 1/30

[52] U.S. Cl. ..... 400/175; 400/144.2

[58] Field of Search ..... 400/175, 144.2

[56] References Cited

U.S. PATENT DOCUMENTS

| | | | |
|---|---|---|---|
| 3,878,929 | 4/1975 | Orlens et al. | 400/175 |
| 3,986,593 | 10/1976 | Orlens et al. | 400/175 |
| 4,036,348 | 7/1977 | Guerrini | 400/175 |
| 4,299,502 | 11/1981 | Harre | 400/175 |
| 4,314,770 | 2/1982 | Harre | 400/175 |
| 4,363,559 | 12/1982 | Suzuki et al. | 400/175 |
| 4,408,909 | 10/1983 | Asano et al. | 400/175 |
| 4,410,288 | 10/1983 | Holmes, Jr. | 400/175 |

*Primary Examiner*—Edgar S. Burr
*Assistant Examiner*—David A. Wiecking
*Attorney, Agent, or Firm*—Silverman, Cass & Singer, Ltd.

[57] ABSTRACT

A radially displaceable coupling between a printing disc and the drive shaft of a printing machine. A bracket having a planar surface is secured to the drive shaft, the bracket having a planar face. Clamps are provided on one of the disc and bracket faces for engagement with the other of said disc and face. A resilient arm, including a zig-zag configured portion terminating in a blade having an inclined lateral surface, is formed on one of the disc and bracket and a recess is provided in the other of the disc and bracket for receiving the resilient arm to effect securement therein in a wedgelike engagement. A lateral surface borders the recess and coacts with the lateral blade surface. The lateral surfaces are convergent relatively coacting when the arm is engaged within the recess to prevent angular movement of the disc and to cause the disc to bear against the drive shaft at a location diametrically opposite to the location of the recess.

7 Claims, 6 Drawing Figures

REMOVABLE PRINTING DISC COUPLING FOR PRINTING MACHINE

BACKGROUND OF THE INVENTION (a) Field of the Invention

The present invention relates means for removably coupling a printing disc on a printing machine drive shaft and more particularly provides a bracket secured to the drive shaft and having a planar face to the disc engaged thereon during the course of a radial displacement, one of the disc and bracket having clamp means securable and, additionally to the other, and resilient cooperable coupling means formed on the disc and bracket whereby angular as well as radial movement of the disc on the drive shaft is prevented.

(b) Description of the Prior Art

Removable securement of printing discs of the type, also known as daisy printing wheels, onto the driving shaft of a printing machine gives rise to delicate problems by reason of the diverse conditions which have to be fulfilled.

For example, the mounting and the removing of the printing disc must be easy and rapid in order to enable the user of the machine rapidly to change the disc when he wants to change the printing type. The securing of the disc on the drive shaft must be reliable and must resist dislodgement under the accelerations and decelerations of very high rotational speed to which the disc is subjected in use. Additionally, the radial and angular position of the disc with respect to the drive shaft must be perfectly precise.

Prior attempts to provide constructive solutions to these problems have been suggested, but none of them is entirely satisfactory to meet all the criteria referred to hereinabove. It would be of considerable advantage to provide a single structure meeting the above criteria.

SUMMARY OF THE INVENTION

The invention herein provides a bracket securable to the drive shaft of a printing machine, the bracket having a planar face. One of the disc and bracket includes clamp means engageable with the other.

One of the disc and bracket carries a resilient locking member arranged to engage a recess carried by the other of the disc and bracket, at least one of the locking member and recess having converging lateral faces whereby engagement of the locking member in the recess locks angularly the disc on the bracket during movement of the disc in a direction radially relative to the drive shaft engaging the planar face of the bracket.

DESCRIPTION OF THE PREFERRED EMBODIMENTS

Figure 1:
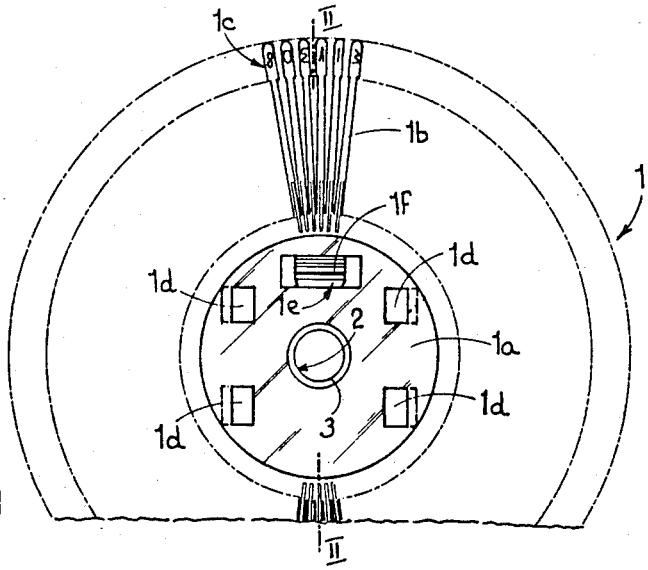
FIG. 1 is a fragmentary elevational view of a printing disc for use on a printing machine and embodying the invention herein.
Figure 2:
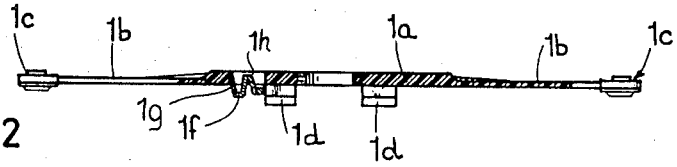
FIG. 2 is a diametrical sectional view of the printing disc taken along line II—II of FIG. 1 but illustrating the full disc.

The printing disc as represented in the figures is formed of plastic material, and is generally designated by reference character 1. The disc 1 comprises a hub 1*a* and radial elastic arms 1*b* carrying, at their ends, type characters 1*c*. The hub 1*a* is provided with a central hole 2 in which a metallic ring 3 is seated. Ring 3 optionally may be provided with one or more radial holes. Hub 1*a* is provided with four clamps 1*d*, of L-shaped cross section, intended to be engaged on bracket 5 upon radial displacement of the disc 1 in the direction indicated by the arrow 4 of FIG. 3. Bracket 5 includes a square flange 5*a* at one end of a sleeve 5*b* which is secured on the drive shaft 6 of the typing machine, the motor of which is represented partially at 7 in FIG. 3. A finger 8 for retaining disc 1 on the bracket 5 is seated slidably within the sleeve 5*b* and is engaged within the central hole 2 of the disc when the disc 1 is engaged on the bracket 5.

The bracket 5 on which the disc 1 is received will not be disclosed herein in greater detail since it is described and illustrated in Swiss Patent Application Ser. No. 850/82 of the same Applicant herein.

Figure 4:
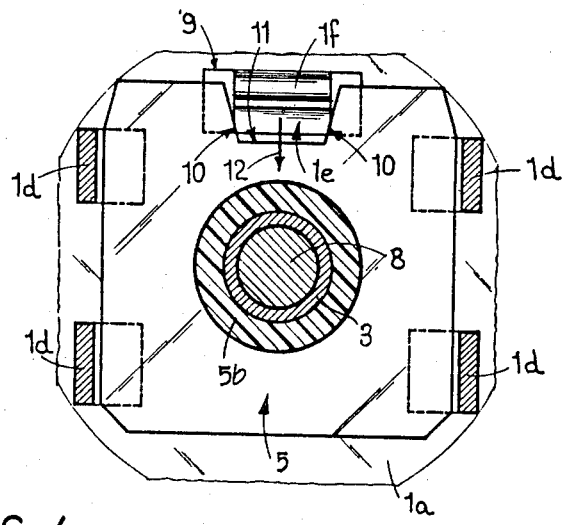
FIG. 4 is a sectional view taken along line IV—IV of FIG. 3 and in the direction indicated.
Figure 5:
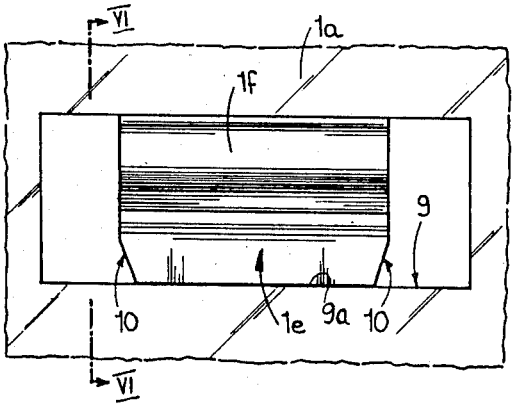
FIG. 5 is an enlarged detail of the printing disc.
Figure 6:
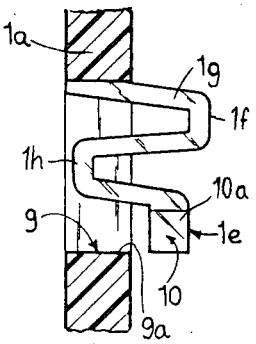
FIG. 6 is a sectional view taken along line VI—VI of FIG. 5.

The clamps 1*d* carried by disc 1 engage the bracket 5 with a slight play minimized but sufficient to enable the mounting and removal of the disc rapidly. The disc 1 is provided with means intended to lock the disc 1 angularly on the bracket 5 whereby any angular play of the disc is prevented during the inversions in the direction and speed of rotation of the drive shaft 6 as well as during the stoppings and starting of rotation of said shaft 6. Locking means contemplated by the invention comprise a locking member carried by the disc 1 including a thin elastic arm 1*f* of zig-zag configuration, one end 1*g* being integral with the disc 1 and the arm 1*f* extending at 1*h* partially within opening 9 in the disc 1. The arm terminates in a blade formation 10 having a lateral inclined face 10*a* converging in a direction away from the opening 9 formed in the disc 1, the blade formation 10 being located at the edge 9*a* opposite the portion 1*g*. The disc 1 includes a generally planar hub portion 1*a* carrying the opening 9 and the thin elastic arm 1*f* formed unitary therewith. As mentioned, the arm 1*f* is formed in a zig-zag configuration portion 1*h* partially located within the opening 9. The blade formation 10 engages a V-shaped recess 11 carried by the bracket 5 when the disc 1 is mounted on the bracket 5, particularly on the planar surface 5*c* thereof. The blade formation 10 operates as a wedge, the arm 1*f* being then elastically deformed and being urged to return the blade formation 10 in a radial direction toward the center, as represented by the arrow 12 in FIG. 4. Accordingly, any angular play of the disc 1 on the bracket face 5*a* is prevented.

Figure 3:
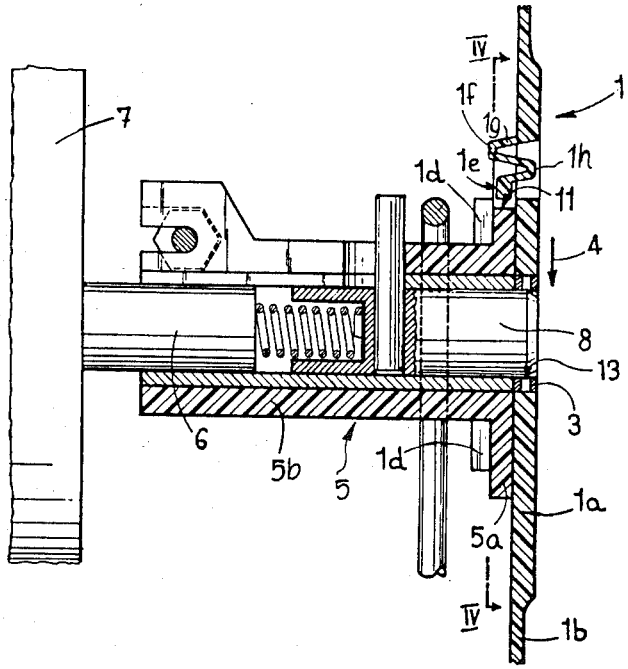
FIG. 3 is an enlarged longitudinal sectional view of the printing disc according to the invention mounted on the end of the drive shaft of the printing machine.

It is to be noted that the resilient arm 1*f*, and particularly the zig-zag portion 1*h* thereof (including formation 10) cooperating with the bracket causes the disc 1 and particularly the ring 3 to be maintained in bearing relationship on the central finger 8 at a location indicated at 13 in FIG. 3, which is adjacent the blade formation 10 and can be described as diametrically opposed to the flange portion 1*g* of arm 1*f*, taking into account the fact that a slight play between the central hole 2 and the finger 8 cannot be prevented regardless of the precision of the manufacturing. Thus, radial movement of the disc 1 also is prevented relative to the bracket 5.

The present device can be the object of the following variations without departing from the scope of the claims.

For example, the locking member can be carried by the bracket 5 instead of by disc 1 and accordingly would protrude from the outer planar face 5*c* of bracket 5. In this case, the disc 1 will be provided with a radial split the length of which will be sufficient for permitting to put the disc in place and to remove it and the extremity of which is situated towards the center and will be provided with converging faces with which the locking member carried by the bracket will cooperate in order to secure the disc therein.

Regardless of whether the locking member is carried by the disc or by the bracket, it is not required to be unitary with the member carrying same but can be constituted by a plug (not shown) capable of radial movement on this member to engage within a recess carried by the other cooperating element to ensure locking of the disc.

Additionally, one of the locking member and recess can present converging edges with the other element having parallel edges which would not prevent the wedging relationship to occur.

We claim:

1. Coupling means for removably securing a printing disc on the motor drive shaft of a printing machine, including a bracket secured to the drive shaft and having a generally planar face which receives the disc engaged thereon during the course of a radial displacement relative to the drive shaft, said coupling means comprising clamp means carried by one of the disc and bracket adapted to be coupled to the other of the disc and bracket, a resilient locking member formed on one of the disc and bracket and capable of radial movement relative thereto and recess means formed on the other of said disc and bracket for receipt of said locking member therein, at least one of the said locking member and recess means having converging lateral faces to enable the engagement of the locking member in the recess means to prevent angular movement of the disc on the bracket, said disc having a central hole and a plug slidably mounted through said central hole.

2. The coupling means as claimed in claim 1, in which said locking member comprises a flange formed on one of the disc and bracket, said flange including an elastically deformable arm unitary therewith and capable of causing said flange to move in a radial direction, with respect to the central hole or plug.

3. The coupling means as claimed in claim 2, in which said elastically deformable arm is a resilient arm formed in a zig-zag configuration, said arm having a terminal blade formation.

4. The coupling means as claimed in claim 1, in which the locking member is carried by the disc and said recess means being defined by a notch formed in an edge of the bracket and located opposite said locking member so as to be engageable therewith upon radial movement of the disc relative to the shaft and engagement with the planar face of the bracket.

5. The coupling means as claimed in claim 1, in which the lateral edges of the locking member includes lateral terminal edges and the recess means includes a recess having converging edges whereby the locking member engages the recess in a wedge-like engagement.

6. Coupling means for removably securing a printing disc on the motor drive shaft of a printing machine including a bracket secured to the drive shaft and having a generally planar face which receives the disc engaged thereon during the course of a radial displacement relative to the drive shaft, said coupling means comprising clamp means carried by one of the disc and bracket adapted to be coupled to the other of the disc and bracket, a resilient locking member formed on one of the disc and bracket and capable of radial movement relative thereto and recess means formed on the other of said disc and bracket for receipt of said locking member therein, at least one of the said locking member and recess means having converging lateral faces to enable the engagement of the locking member in the recess means to prevent angular movement of the disc on the bracket, said disc having a central hole, said bracket including a maintaining finger portion associated therewith and coaxial with the drive shaft, said disc being mountable on the bracket with the maintaining finger portion passing through the central hole and said resilient locking member causing said disc to bear against said maintaining finger portion at a location diametrically opposite to the location of said resilient locking member.

7. Coupling means for removably securing a printing disc on the motor drive shaft of a printing machine thereof, including a bracket secured to the drive shaft and having a generally planar face which receives the disc engaged thereon during the course of a radial displacement relative to the drive shaft, said coupling means comprising clamp means carried by one of the disc and bracket adapted to be coupled to the other of the disc and bracket, a resilient locking member formed on one of the disc and bracket and capable of radial movement relative thereto and recess means formed on the other of said disc and bracket for recepit of said locking member therein, at least one of the said locking member and recess means having converging lateral faces to enable the engagement of the locking member in the recess means to prevent angular movement of the disc on the bracket, said disc having an opening formed therein, said locking member including a flange portion unitary with the disc and extending outward therefrom adjacent said opening, a zig-zag intermediate formation having a portion within said opening said portion having a free end and a terminal blade formation unitary with the free end of said portion, said blade formation having at least one inclined surface, a portion of said zig-zag formation and said blade formation being received in said recess means when the disc is displaced in a radial direction relative to the shaft to engage the planar surface of the bracket.

* * * * *